United States Patent [19]

Land

[11] Patent Number: 4,982,503

[45] Date of Patent: Jan. 8, 1991

[54] ARCHERY BOW SIGHT

[76] Inventor: Leo Land, 1777 San Gabriel Dr., Yuma, Ariz. 85365

[21] Appl. No.: 408,897

[22] Filed: Sep. 18, 1989

[51] Int. Cl.[5] ..... F41G 1/00

[52] U.S. Cl. ..... 33/265; 33/258

[58] Field of Search ..... 33/265, 248, 257, 258; 124/87, 88

[56] References Cited

U.S. PATENT DOCUMENTS

| | | | |
|---|---|---|---|
| 2,542,501 | 2/1951 | Fredrickson | 33/46 |
| 2,545,454 | 3/1951 | Fredrickson | 33/265 |
| 2,559,927 | 7/1951 | Beloungy | 33/46 |
| 3,058,221 | 10/1962 | McNeel | 33/265 |
| 3,648,376 | 3/1972 | Millnamow | 33/46 |
| 4,141,163 | 2/1979 | Rubin | 33/244 |
| 4,162,579 | 7/1979 | James | 33/265 |
| 4,294,017 | 10/1981 | Byrnes et al. | 33/265 |
| 4,417,403 | 11/1983 | Strange | 33/265 |
| 4,494,313 | 1/1985 | Scott | 33/265 |
| 4,542,591 | 9/1985 | Montgomery | 33/265 |
| 4,570,352 | 2/1986 | Leal | 33/265 |
| 4,602,437 | 7/1986 | Berthiaume | 33/265 |

OTHER PUBLICATIONS

Cobra Hunting Products, J. T. Smith, Oct. 1987, p. 1.

*Primary Examiner*—William A. Cuchlinski, Jr.
*Assistant Examiner*—Alvin Wirthlin
*Attorney, Agent, or Firm*—LaValle D. Ptak

[57] ABSTRACT

An archery bow sight, for improving the accuracy of shooting by an archer and reducing cant in the use of the bow, comprises front and rear horizontal and vertical cross-hair sets located within front and rear sights which are mounted on a support member attached to sight holes on the bow. The cross-hairs sets are adjusted so that they are superimposed when the archer draws the bow to the normal anchor point. Shooting pins are provided in the front sight to provide centering points for targets located at various distances from the bow. In use, the shooting pins are centered on the target with the front and rear cross-hair sets perfectly aligned with or superimposed with one another. When this is done, cant of the bow readily may be reduced or eliminated.

7 Claims, 1 Drawing Sheet

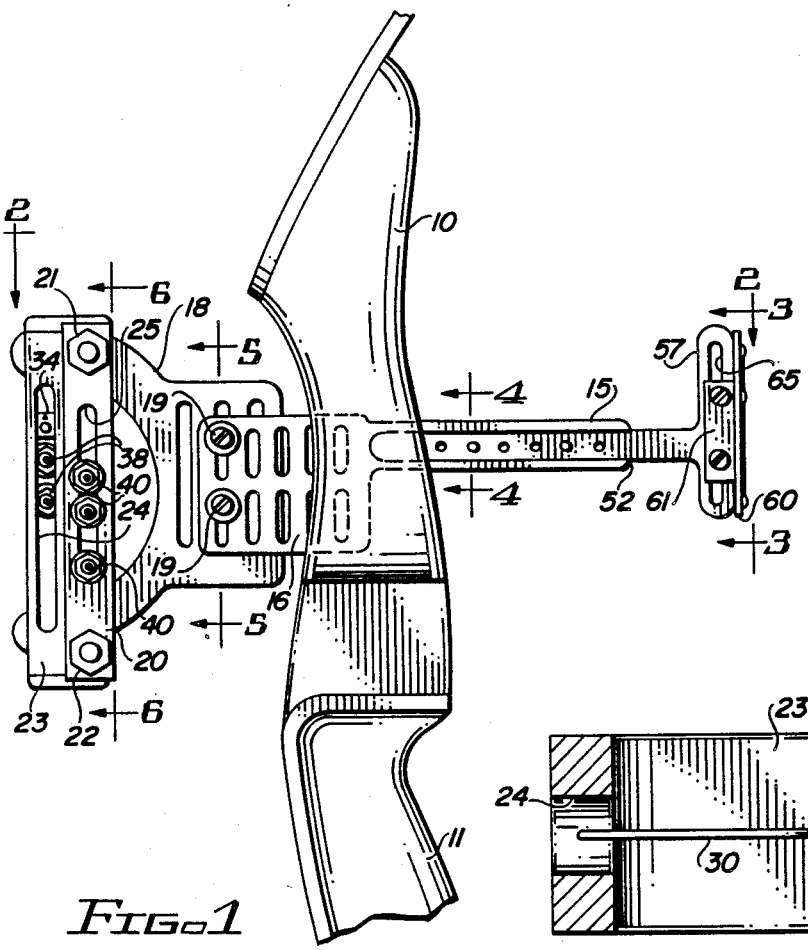
FIG. 1
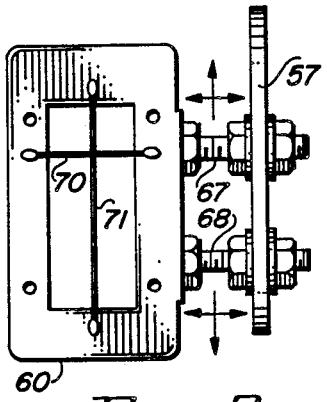
FIG. 3
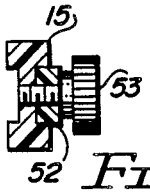
FIG. 4
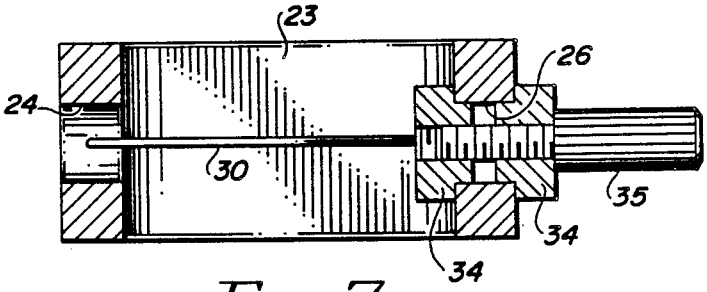
FIG. 7
FIG. 2
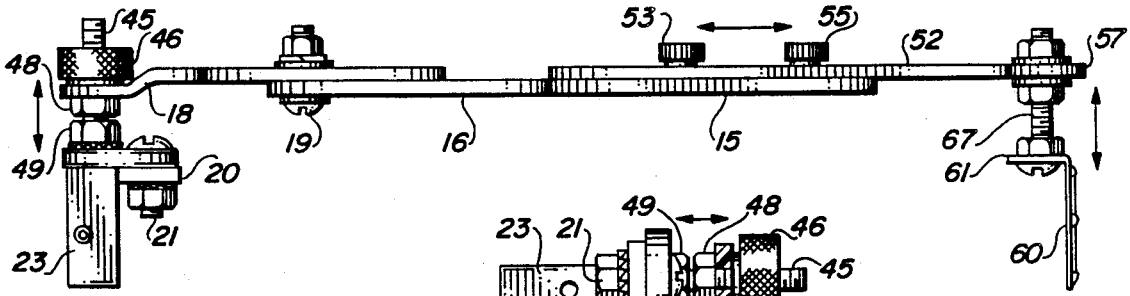
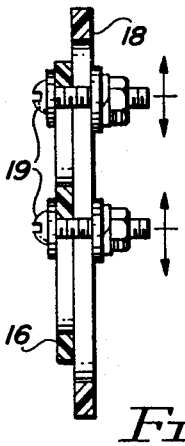
FIG. 5
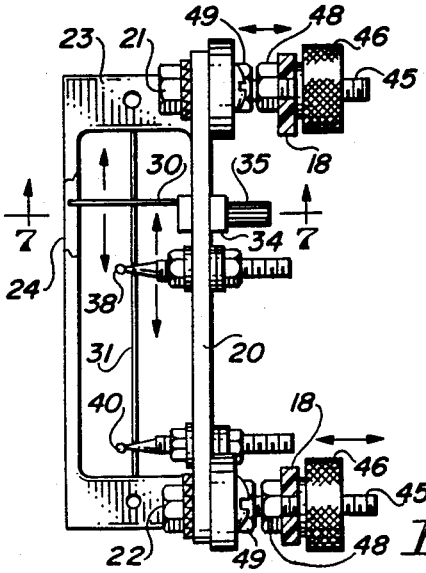
FIG. 6

ARCHERY BOW SIGHT

BACKGROUND

Archery bows are widely used both for target shooting and for use in hunting wild game. To improve the accuracy of the use of archery bows at different distances from the target, various sighting devices have been devised. Compound hunting bows typically are sold with sight holes or attachment points on the bow above the arrow rest for attaching a sight to the bow.

A variety of different types of sighting devices have been developed for use with archery bows, particularly those used for hunting. The most accurate of such prior art sighting devices employ both front and rear sight members which generally include provisions to compensate for the varying amounts of vertical drop or differing trajectories which occur when the selected targets are at different distances from the archer. While most such prior art bow sights improve the accuracy of use of the bow over a bow with no sight at all, significant disadvantages still result. It is difficult, for example, particularly in a hunting situation when the target is present for a relatively short period of time, to eliminate cant from the bow at the time it is sighted on the target and during the release of the arrow.

Patents which are directed to archery bow sights which include front and rear sight elements for improved accuracy, are the U.S. Pat. No. 4,162,579 to James; 4,417,403 to Strange; 4,494,313 to Scott; and 4,542,591 to Montgomery.

The James and Scott Patents disclose front and rear sight platforms which are attached to the bow riser. The rear sight is simply a notch (which is convertible to a circular aperature or "peep" sight in James). The front sight embodies multiple pins located at different vertical spacings corresponding to various distances of the target from the bow. In James, the desired pin must be rotated into place each time a new distance is selected. The rear sight is located in close proximity to the archer's eye and the notch is aligned with the selected bead corresponding to the target distance. It is difficult to accurately align the notch (or the peep hole) with the selected bead, so that this which will permit the archer to eliminate or reduce cant of the bow. Also, in James, the rear sight extends past the string, which presents a problem.

The sight of the Montgomery Patent is similar in some respects to the one of the Scott Patent, but the rear sight is a peep sight which is mounted to the bow riser instead of the string. To use this sight, the bead in the rear or peep sight portion is aligned with a front bead selected to correspond with the shooting distance from the target. A sight of this type is difficult to align under low light conditions; and there is no provision for eliminating or reducing cant in the sight disclosed in the Montgomery Patent.

The fourth Patent of this group is the U.S. Pat. No. 4,417,403 to Strange. The sight of Strange includes a single front bead with a rotatable rear peep sight in which a pair of vertical and horizontal cross-hairs are mounted. The sight disclosed in the Strange Patent may be of some value for target shooting, but it is impractical for hunting. Under hunting conditions where the target distance must be rapidly selected, insufficient time would exist to adjust the rotational position of the rear sight to obtain any accuracy. Once again, there is no provision in the sight disclosed in the Strange Patent for eliminating or reducing cant of the bow.

The U.S. Pat. No. 3,648,376 to Millnamow discloses a sight employing a single bead for the front sight. The rear sight is a telescope with cross-hairs in it. This sight, like the sight of Strange, is impractical for hunting. It is necessary to move the entire sight up a vertical slide bar to set the sight for different yardages. The sight may be applicable for target shooting, but it does not permit rapid and accurate changes for targets at varying distances from the archer. As with the other patents which have been discussed above, the Millnamow Patent does not disclose any provision for reducing or eliminating cant.

The U.S. Pat. No. 4,570,352 to Leal discloses a bow sight, having front and rear sight elements in it, which is intended to be applicable to both target shooting and hunting applications. The rear sight utilizes a pair of vertical and horizontal cross-hairs. The front sight is a staircase configuration, with the different steps of the staircase selected to correspond to different shooting distances from the target. To use this sight, the cross-hairs of the rear sight are aligned on a target and the bow is elevated to place the selected portion of the staircase arrangement of the front sight into alignment with the cross-hairs. The selected step corresponds to the distance of the archer from the target. In contrast to some of the other patents discussed above, the intent of the Leal Patent is to permit rapid selection of the target distance in conjunction with utilization of the sight. It is not necessary for the archer to make any adjustments of the sight in order to effect the distance selection. Since a single fixed staircase notched front sight is employed, independent adjustment of different distances is not possible. Consequently, it appears that this front sight must be selected for a particular bow and also is capable of optimum function only within a limited arrow speed. The selection of the desired one of the various staircase steps under hunting conditions, where quick selection of the right point is imperative, also may be difficult. As with the other patents, there is no provision in the sight of the Leal Patent to minimize or eliminate cant of the bow.

SUMMARY OF THE INVENTION

Accordingly, it is an object of this invention to provide an improved archery bow sight.

It is an additional object of this invention to provide an archery bow sight which minimizes cant of the bow in use.

It is another object of this invention to provide an improved archery sight which simultaneously assists the archer in eliminating cant and permits quick selection of yardage shooting indicia for adjusting the shooting angle corresponding to the distance a target is from the bow.

It is a further object of this invention to provide a bow-mounted front and rear sight combination for facilitating accurate target distance adjustments while simultaneously minimizing cant of the bow under both target and hunting use.

In accordance with a preferred embodiment of this invention, an archery bow sight for attachment to an archery bow includes an elongated support. This support is attached rigidly to the bow. A front sight member is attached to the front of the support and a rear sight member is attached to the rear of the support. Both the front and rear sight members have vertical and horizontal cross-hair pairs in them. The cross-hairs are adjusted in both of the sight members; so that when an archer using the bow has pulled the bow to its full draw and to that archer's normal anchor, the horizontal and vertical cross-hairs of the front and rear sight members are superimposed. This provides an accurate orientation to the archer to permit the archer to eliminate cant, while at the same time allowing other portions of the front sight member to be utilized to provide proper distance adjustment of the angle of the bow with respect to the selected target.

BRIEF DESCRIPTION OF THE DRAWING

FIG. 1 is a side view of a preferred embodiment of the invention illustrating its position as used in conjunction with a bow;

FIG. 2 is a top view of the embodiment of the invention shown in FIG. 1;

FIG. 3 is a rear view of a portion of the embodiment shown in FIG. 1, taken along the line 3—3 of FIG. 1;

FIG. 4 is a cross-sectional detail of a portion of the invention taken along the line 4—4 of FIG. 1 to illustrate the manner of interconnecting parts together;

FIG. 5 is a cross-sectional view, taken along the line 5—5 of FIG. 1, showing the manner of attachment of parts of the embodiment of FIG. 1 together:

FIG. 6 is a view, taken along the line 6—6 of FIG. 1, to illustrate a portion of the invention shown in FIG. 1: and FIG. 7 is an enlarged cross-sectional view, taken along the line 7—7 of FIG. 6, to show a detail of a portion of the invention.

DETAILED DESCRIPTION

Reference now should be made to the drawing in which the same reference numbers are used throughout the various figures to designate the same components.

The archery bow sight is illustrated in FIG. 1 in a side view which shows the manner in which the various components are attached to the bow and to one another. A support member includes a front portion 16 with several parallel rows of elongated slots in it, as shown most clearly in FIG. 1. This portion is interconnected with an integrally formed rear extension 15, as shown most clearly in FIGS. 1 and 2. Two or more of the slots in the portion 16, such as those indicated in dotted lines in FIG. 1, are attached to the bow 10 at the normal sight holes in the bow. This attachment is above the hand grip portion 11 and above the arrow rest (not shown). This is a conventional attachment where bow sights typically are connected to the bow 10.

A front sight 23 is attached to a plate 18, which in turn is connected forward of the bow 10 a suitable distance. This is accomplished by means of a pair of bolts 19 which extend through upper and lower ones of the elongated slots in the portion 16 and through a corresponding slot in the plate 18. Since the elongated slots in the members 16 and 18 are aligned with one another, vertical adjustment of the bracket 18 for the front sight is effected in accordance with the particular desires of the archer using the sight. This adjustment capability is shown most clearly in FIG. 5.

The forward end of the plate 18 has the front sight member 23 attached to it. This front sight member is generally in the form of an elongated rectangle with the center portion open, as shown most clearly in FIG. 6. The edges of the member 23 have elongated slots 24 and 26 in them (shown most clearly in FIGS. 1 and 7) to permit adjustable yardage shooting pins 38 (FIGS. 1 and 6) to be vertically moved within the rectangular opening in the member 23. Shooting pins of this type are utilized with a variety of different hunting bow sights, and the manner of adjustment of these pins vertically within the slot 26 and horizontally across the opening is in accordance with well known applications. In addition to various yardage shooting pins 38, however, the front sight member 23 also has a horizontal cross-hair wire or rod 30 located in it. This horizontal cross-hair 30 is carried by a movable clamp block 34, which slides vertically in the right-hand slot 26 to a selected vertical position as desired. This positioning of the cross-hair 30 is discussed more fully subsequently. Once the desired position has been obtained, a thumb screw 35 is turned to tighten a clamp 34 to hold the horizontal cross-hair 30 in the selected position. It is readily apparent from an examination of FIGS. 1, 6 and 7, that this vertical adjustment is quickly and readily obtained.

Also, as shown in FIG. 6, the front sight block 23 carries a solid vertical cross-hair or wire 31 extending from end to end across the opening in the block. This vertical cross-hair 31 is permanently secured to the center of the sight 23 by any suitable means. Adjustment of the vertical position of the cross-hair 31 with respect to the bow 10, is effected by means of adjustment rods 45, thumb screws 46, and spacer nuts 48 and 49, all of which are threaded onto the rods 45. Loosening of the thumb screws 46, at both the upper and lower positions of the block 23, as shown most clearly in FIG. 6, permits suitable counter-rotation of the nuts 48 and 49 to change the distance between the plate 18 and the right-hand edge of the front sight block 23 (as viewed in FIG. 6) to space the block 23 at varying distances from the plate 18 or to tilt the vertical cross-hair 31 in one direction or the other depending upon the spacing selected by adjustment of the nuts 48 and 49 on each of the threaded rods 45 at the top and the bottom of the block 23. Once the desired angular orientation of the vertical cross-hair 31 has been effected, the thumb screws 46 on both the upper and lower rods 45 are tightened to hold everything in place.

A rear sight is attached to the extension 15 of the support bracket by means of a pair of threaded thumb screw fasteners 53 and 55 which extend through an elongated rod 52. The rod 52 is placed at selected positions along the extension 15 by threading the fasteners 53 and 55 into spaced pairs of holes in the member 15. This is shown in detail in FIG. 4, for the fastener 53; and FIG. 2 provides top view, showing the manner in which the member 52 is adjustably located along the extension 15.

The rear or rightward portion of the member 52 has a vertical extension 57 on it. The extension 57 also includes an elongated slot 65 through it to permit vertical adjustment or mounting of a rear sight 60, in the form of an elongated rectangle with a rectangular opening in its center. As shown in FIG. 3, the rear sight 60 has a flange 61 which is attached to the member 57 by means of threaded rods 67 and 68, which permit adjustment of the rear sight 60 in the same manner described above in conjunction with the adjustment of the front sight on the threaded rods 45.

The rear sight 60 has a horizontal cross-hair 70 and a vertical cross-hair 71 set permanently attached in the opening in it. The point of crossing of the cross-hairs 70 and 71, however, is vertically adjustable by means of the rods 67 and 68 which may be moved vertically in the slot 65 and then tightened in place by the nuts on the rods 67 and 68.

In a manner similar to the adjustment of the vertical Q orientation of the vertical cross-hair 31 for the front sight, a similar adjustment of the cross-hair 71 of the space between the rear sight 60 and the extension 57 is effected by adjustments of the nuts on the threaded rods 67 and 68.

To properly use the sight which has been described above, it is necessary to effect initial adjustments to uniquely adapt the sight for use of the archer using the particular bow on which the sight is mounted. Once the sight has been mounted to the bow 10, as described above, the archer must decide which side of the string his shooting eye will be on when the bow is at full draw. Different archers draw the bow to different anchor points which in turn cause this location to differ. Any given archer pulls the bow to the same anchor point for each shot. This anchor is a consistent spot on the face of the archer. Commonly, it is the corner of the mouth or under the jaw bone.

If the archer sights on the right side of the string, the rear vertical cross-hair 71 position is adjusted by means of the nuts on the threaded rods 67 and 68 to cause the rear vertical cross-hair 71 to be slightly to the right of the string and perfectly parallel to the string. If the archer prefers to sight on the left side of the string, the rear sight 60 is adjusted so that the vertical cross-hair 71 in the window or opening of the rear sight 60 is slightly to the left of the string. If a peep sight is used on the string, the vertical cross-hair is adjusted to the center of the string. It should be noted that the sight disclosed is attached in a manner such that the rear sight 60 is forward of the string, so that no interference between the sight and the string of the bow occurs.

With an arrow on the arrow rest in the drawing position of the bow, the front vertical cross-hair 31 is aligned with the back vertical cross-hair 71, parallel to the string, and with the same distance from the string as the back vertical cross-hair 71. This is determined by the archer imperically by sight. If an adjustment needs to be made, the front sight may be moved in and out, and the vertical cross-hair 31 may be tilted in the manner described above by adjustment on the threaded rods 45.

Looking from the back of the bow 10, with the arrow in place, the center of the entire arrow is aligned with the center of the string. When this is done, the rear vertical cross-hair 71 and the front vertical cross-hair 31 should be so aligned that they are in the same plane from the front to the rear of the arrow. These vertical cross-hairs 31 and 71 now also should align with minimal head movement when the archer pulls the bow to a full draw and to the normal anchor. This alignment is checked several times until the archer is comfortable with the positions of the vertical cross-hairs 31 and 71.

After the vertical cross hairs 31 and 71 are adjusted, as described above, the horizontal front cross-hair 30 and the horizontal rear cross-hair 70 are adjusted to superimpose when the archer pulls the bow to full draw at the normal anchor. As described previously, the vertical positioning of the front cross-hair 30 is effected by moving the block 34 up and down in the slot 26 when the knurled adjusting knob 35 is loosened. Once the proper position is found, the knob 35 is tightened to hold the front cross-hair 30 in place. For the rear cross-hair 70, the entire rear sight 60 is moved vertically up or down in the slot 65 in the extension 57, as described previously. The proper position of the horizontal cross-hairs 30 and 70 is determined imperically through trial and error shooting. These cross-hairs typically are adjusted, so that they are approximately one-fourth inch (¼") above the twenty yard shooting pin. Such a pin g typically is the pin which is closest to the cross-hair 30 in the front sight.

The various yardage shooting pins 38, which are movable in the slot 26 in a manner similar to the movement of the cross-hair 30, and additional shooting pins 40 which are movable in a slot 25 on an auxiliary shooting pin bar 20, are adjusted to establish the different shooting yardages to be set for the bow. It should be noted that the auxiliary shooting pin bar 20 is attached to the front sight 23 by means of threaded fasteners 21 and 22, which pass through extensions located at the top and bottom of the front sight 23 (as shown most clearly in FIG. 2). As is well known, the shooting pins are adjusted through trial and error shootings. Consequently, once the various yardages are set, the pin head is held dead center on the target, with the front and rear cross-hairs 30/31 and 70/71 perfectly aligned and superimposed with one another.

Once these initial adjustments have been made, with practice, the cross-hairs of the front and rear sights will align automatically to the archer's constant anchor point. It also has been found that an ideal adjustment is accomplished when the shooting pins 38 and 40 protrude one-eight inch to three-sixteenth inch to the left of the vertical cross-hair 31 in the front sight 23 for a right-handed shooter, and the same distance to the right of the vertical cross-hair 31 for a left-handed shooter.

It should be apparent that the above-described adjustment or fine tuning of the sight is accomplished by moving the front and rear vertical cross-hairs (30/31 and 70/71) in opposite directions to one another, much like the adjustments made in front and rear rifle sights. It also is readily apparent from an examination of FIGS. 3 and 6, in particular, that the open rectangles of the front and rear sights 23 and 60 provide a clearly visible shooting picture for the archer with maximum visibility of the yardage shooting pins 38 and 40.

It is important to note, that because the front cross-hairs 30/31 and rear cross-hairs 70/71 always are superimposed and aligned with one another, and the vertical cross-hairs are parallel to the bowstring throughout use of the sight, canting is substantially eliminated. These superimposed sets of cross-hairs provide accurate horizontal and vertical references, and canting is readily ascertained by the archer viewing the target through the sights. Also, it should be noted that this alignment of the cross-hairs is constant at all times in use of the sight. The adjustment of the bow for targets at different distances is effected by selection of the desired pin 38 or 40 which is centered and superimposed on the target point, while simultaneously keeping the cross-hairs (30/31 and 70/71) of the front and rear sights in superimposed alignment with one another.

It also should be noted that as many yardage shooting pins 38 and 40 may be placed on the front sight as the archer is capable of shooting accurately. Typically, each pin is selected to represent a distance ten (10) yards closer than the next lower pin on the front sight. The two rows of pins 38 and 40 are used to permit non-interfering close spacing of the pins. This is commonly done in front bow sights, and no further discussion of that adjustment is considered necessary here. It should be noted that good bow shooters typically are capable of shooting accurately up to sixty (60) yards. Expert archers conceivably are capable of shooting accurately up to one hundred (100) yards. Thus, the number of pins utilized by any given archer is dependent upon that archer's abilities.

The foregoing description of the preferred embodiment of the invention is to be considered illustrative of the invention and not as limiting. Various changes and modifications will occur to those skilled in the art without departing from the true scope of the invention. Clearly, the various adjustment means which have been disclosed may be effected by cam and wedge operations, or the like. The particular shape of the various components is also not significant with the exception of the necessity for using straight rods, wires or the like for the cross-hair elements. Consequently, various changes may be made to the embodiment disclosed without departing from the true scope of the invention as defined in the appended claims.

I claim:

1. For use with an archery bow having a bowstring, an archery bow sight for attachment to an archery bow above the arrow rest and the hand grip portion, said bow sight including an combination:

an elongated support member for attachment to a bow above the arrow rest and having a front portion extending a first predetermined distance in front of the bow and a rear portion extending a second predetermined distance to the rear of the bow, so that no interference between the bow sight and the bowstring occurs;

front sight means including an open, elongated rectangular frame attached to the front portion of said support member;

rear sight means including an open, elongated rectangular frame attached to the rear portion of said support member;

said front sight means including solid horizontal and vertical cross-hairs in the open frame thereof in a plane perpendicular to said support member;

said rear sight means including solid horizontal and vertical cross-hairs in the open frame thereof in a plane parallel to the plane of said front sight means;

means for independently adjusting the angles of the vertical cross-hairs of both said front sight means and said rear sight means relative to the bow to cause such vertical cross-hairs to be parallel to the bowstring and with one another; and the horizontal and vertical cross-hairs of said rear sight means located to be superimposed with the horizontal and vertical cross-hairs, respectively, of said front sight means in the line of sight of an archer when the archer using the bow has pulled the bow to a full draw and to the archer's normal anchor.

2. The combination according to claim 1 further including means for adjusting the vertical location of the horizontal cross-hair of said front sight means relative to the bow and means for adjusting the vertical location of the horizontal cross-hair of said rear sight means relative to the bow.

3. The combination according to claim 2 wherein said means for adjusting the vertical location of said horizontal cross-hairs of said front sight means and said rear sight means, respectively, comprise means for independently effecting said adjustments of the horizontal cross-hairs of said front sight means and said rear sight means relative to one another.

4. The combination according to claim 1 further including means for adjusting the distance of said front sight means from said rear sight means.

5. The combination according to claim 1 further including yardage shooting indicia adjustably mounted on said front sight means.

6. The combination according to claim 5 wherein said yardage shooting indicia comprises a plurality of yardage shooting indicia vertically moveable to different positions beneath the horizontal cross-hair of said front sight means.

7. A method for reducing cant from an archery bow having a bowstring when such bow is used in hunting or target shooting includes the steps of:

providing a front solid cross-hair set in an open rectangular frame in a front sight located in front of the bow;

providing a rear solid cross-hair set in an open rectangular frame in a rear sight located to the rear of the bow, so that no interference between the sights and the bowstring occurs;

independently adjusting the relative positions of said front and rear cross-hair sets to be parallel to the bowstring and to superimpose on one another in the line of sight of the eye of an archer when the archer draws the bow to a normal anchor position; and adjusting the horizontal cross-hairs in such superimposed position to be located a predetermined distance above a yardage shooting indicia indicative of a pre-established distance from a target.

* * * * *